US006318690B1

(12) United States Patent
Chang et al.

(10) Patent No.: US 6,318,690 B1
(45) Date of Patent: Nov. 20, 2001

(54) RACK FOR HOLDING CYLINDRICAL CONTAINER AND THE LIKE

(76) Inventors: Chin-Yi Chang; Chin-Tzu Chang, both of 103-2P, Sec. 1, Chan Ho Road, Chan-Hua City (TW)

( * ) Notice: Subject to any disclaimer, the term of this patent is extended or adjusted under 35 U.S.C. 154(b) by 0 days.

(21) Appl. No.: 09/588,532

(22) Filed: Jun. 7, 2000

(51) Int. Cl.[7] ..... A47K 1/08
(52) U.S. Cl. ..... 248/312
(58) Field of Search ..... 248/312, 312.1, 248/213.2, 311.2, 225.11

(56) References Cited

U.S. PATENT DOCUMENTS 3,192,894 * 7/1965 Staver ..... 248/225.11 X
3,193,234 * 7/1965 Thurman et al. ..... 248/313
4,909,467 * 3/1990 Shan-Pao ..... 248/312

* cited by examiner

*Primary Examiner*—Ramon O. Ramirez
(74) *Attorney, Agent, or Firm*—Rabin & Berdo, P.C.

(57) ABSTRACT

A rack is formed of a fastening mount, a support arm, and a C-shaped holder. The fastening mount is fastened to a wall by a plurality of fastening screws. The support arm is extended from the support arm and is intended to hold a cylindrical container.

4 Claims, 5 Drawing Sheets

RACK FOR HOLDING CYLINDRICAL CONTAINER AND THE LIKE

FIELD OF THE INVENTION

The present invention relates generally to a rack, and more particularly to a rack designed to hold a cylindrical container.

BACKGROUND OF THE INVENTION

The bathroom items, such as hair shampoo, bath lotion, shaving cream, and the like, are generally kept in a cylindrical container. These bathroom items are often kept on the top of the bathroom washstand and are occasionally tipped over. In addition, the wet bottom of the container promotes the growth of bacteria or fungi.

SUMMARY OF THE INVENTION

The primary objective of the present invention is to provide a rack comprising a fastening mount, a support curved arm, and a C-shaped holder, which are made integrally. The fastening mount is fastened to a wall by a plurality of fastening screws. The C-shaped holder is designed to hold a dispensing cap of the container.

The features and the advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
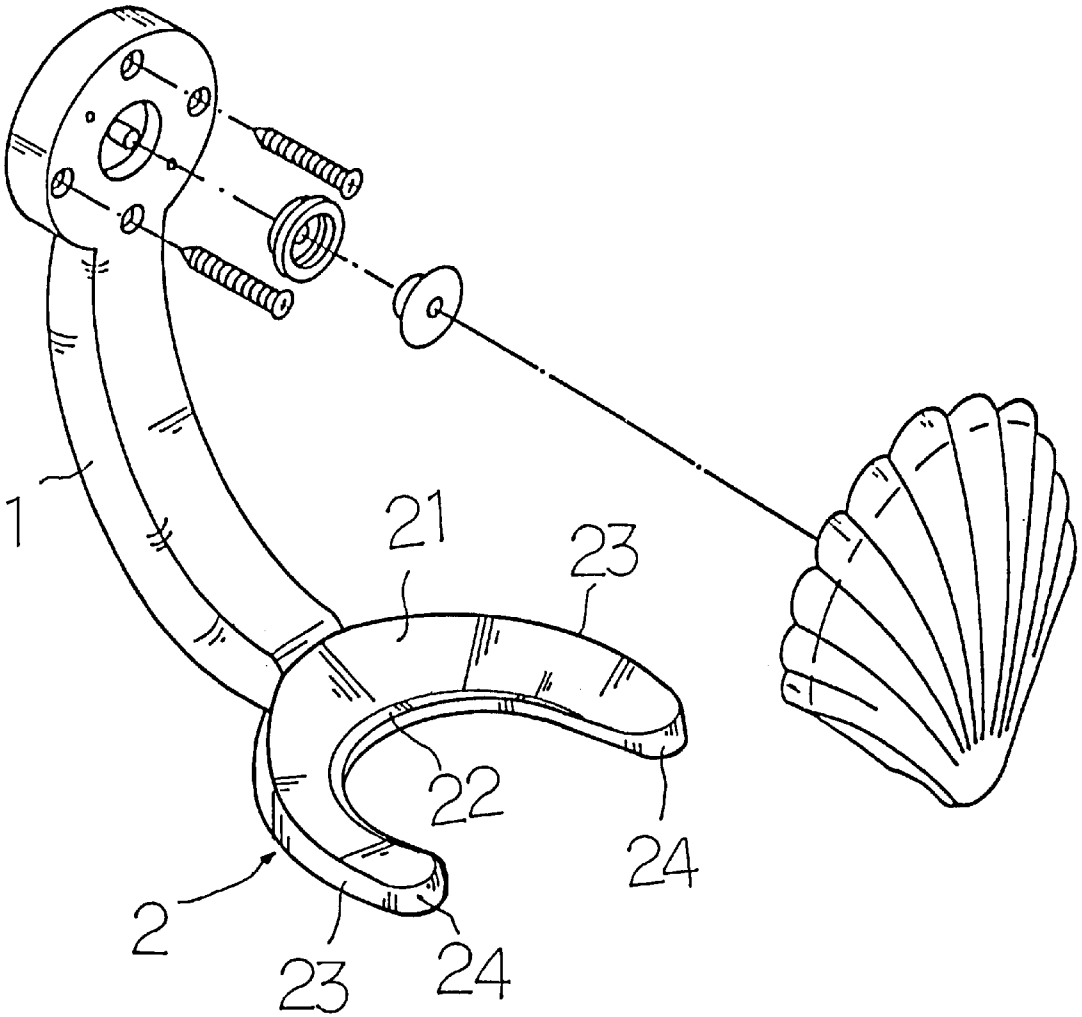
FIG. 1 shows a perspective view of the preferred embodiment of the present invention.
Figure 2:
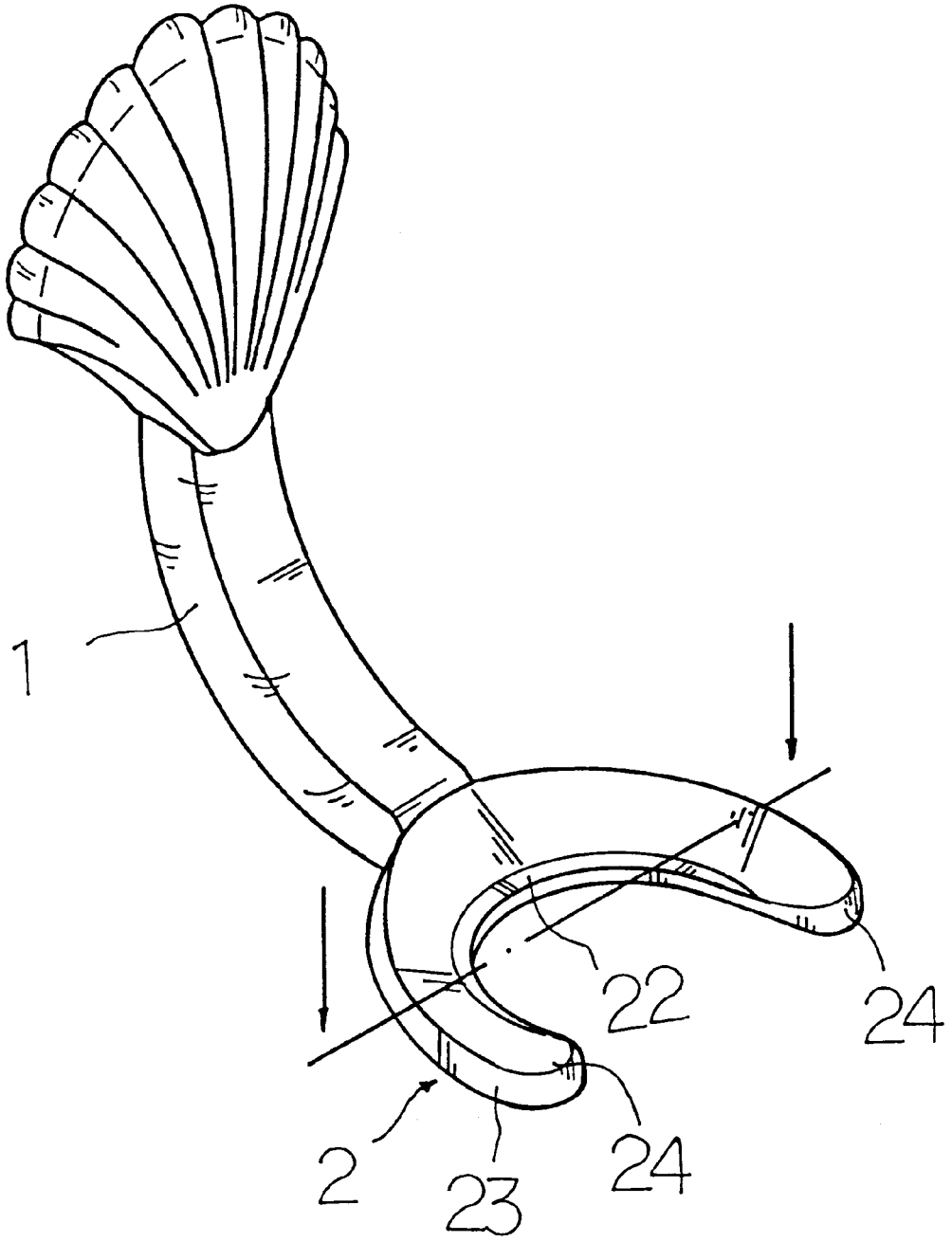
FIG. 2 shows another perspective view of the preferred embodiment of the present invention.

As shown in all drawings provided herein, a rack embodied in the present invention comprises a fastening mount, a curved support arm 1, and a C-shaped holder 2.

The fastening mount is fastened to a wall by a plurality of fastening screws. The curved support arm 1 extends from the fastening mount. The C-shaped holder 2 extends from the curved support arm 1. The rack of the preferred embodiment of the present invention is made integrally.

The C-shaped holder 2 has an inclined upper surface 21, a planar surface 22 located in the center of the front side wall of the C-shaped holder 2, and two free ends 23 which are provided with a warped portion 24.

Figure 3:
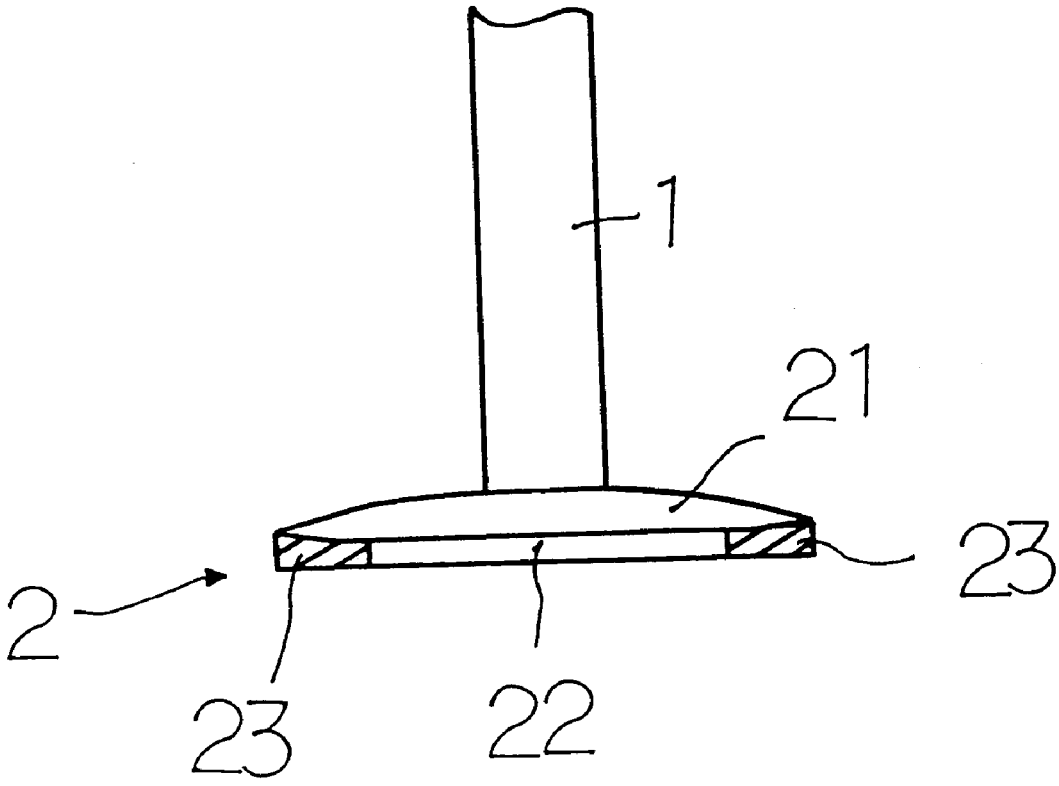
FIG. 3 shows a partial sectional view of the preferred embodiment of the present invention.

As shown in FIG. 3, the upper surface 21 has a tapered region, which extends from a relatively thick outer portion of the holder 2, and which terminates at a planar, flat region disposed on an inner portion of the holder 2.

Figure 4:
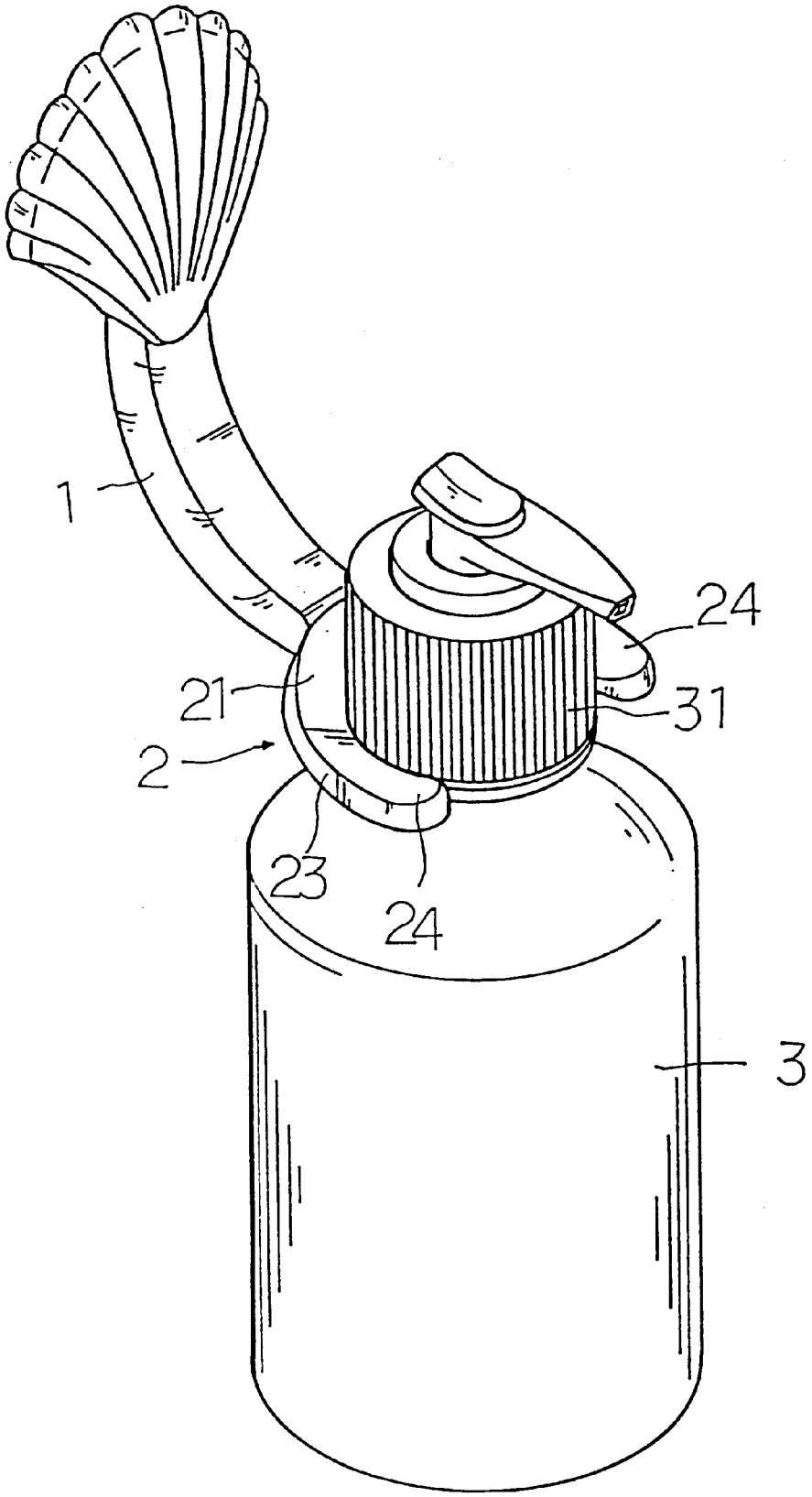
FIG. 4 shows a schematic view of the preferred embodiment of the present invention at work.
Figure 5:
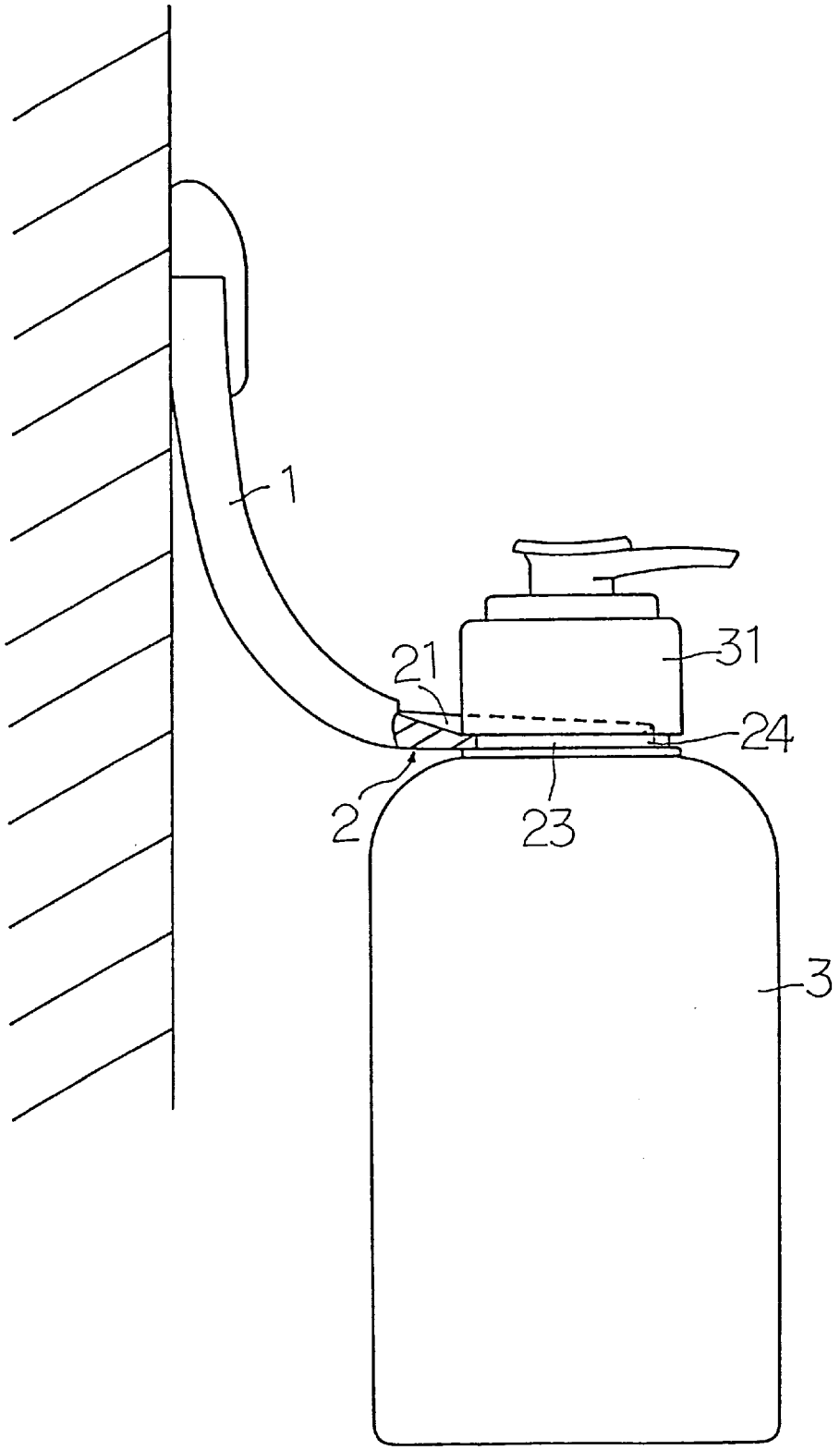
FIG. 5 shows another schematic view of the preferred embodiment of the present invention at work.

As illustrated in FIGS. 4 and 5, the rack of the present invention is intended to hold a cylindrical container 3 having a dispensing cap 31.The contents of the cylindrical container 3 can be dispensed while the cylindrical container 3 is held by the rack of the present invention.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A rack, comprising:

a fastening mount;

a support arm extending from said fastening mount; and a C-Shaped holder extending from said support arm and having an opening for receiving a container, said C-shaped holder having an inner portion disposed around the opening, the inner portion being non-tapered and having an upper horizontal flat surface that is adapted to support the container, said C-shaped holder further having an outer portion that is contiguous with the inner portion, the outer portion being tapered in thickness, so that said holder has a thickness that is greater at an outer peripheral edge thereof than at a transition between the outer portion and the inner portion.

2. The rack as defined in claim 1, wherein said fastening mount, said support arm and said C-shaped holder are integrally formed.

3. The rack as defined in claim 1, wherein said C-shaped holder has two free ends whereby said two free ends are provided with a warped portion.

4. The rack as defined in claim 1, wherein said fastening mount is adapted to be fastened to a wall using a plurality of fastening screws.

* * * * *